US009450298B2

(12) United States Patent
Lee

(10) Patent No.: US 9,450,298 B2
(45) Date of Patent: Sep. 20, 2016

(54) USER-WEARABLE DEVICES WITH PRIMARY AND SECONDARY RADIATOR ANTENNAS

(71) Applicant: Salutron, Inc., Fremont, CA (US)

(72) Inventor: Yong Jin Lee, Seoul (KR)

(73) Assignee: SALUTRON, INC., Fremont, CA (US)

( * ) Notice: Subject to any disclaimer, the term of this patent is extended or adjusted under 35 U.S.C. 154(b) by 30 days.

(21) Appl. No.: 14/661,758

(22) Filed: Mar. 18, 2015

(65) Prior Publication Data

US 2016/0099497 A1 Apr. 7, 2016

Related U.S. Application Data

(60) Provisional application No. 62/058,489, filed on Oct. 1, 2014.

(51) Int. Cl.

| | |
|---|---|
| ***H01Q 1/24*** | (2006.01) |
| ***H01Q 1/27*** | (2006.01) |
| ***H01Q 1/38*** | (2006.01) |
| *H01Q 7/00* | (2006.01) |

(52) U.S. Cl.
CPC ..... *H01Q 1/273* (2013.01); *H01Q 1/38* (2013.01); *H01Q 7/00* (2013.01)

(58) Field of Classification Search
CPC ..... H01Q 1/273; H01Q 1/24; H01Q 1/243
USPC ..... 343/718, 702
See application file for complete search history.

(56) References Cited

U.S. PATENT DOCUMENTS

| | | | | |
|---|---|---|---|---|
| 6,919,858 | B2 | 7/2005 | Rofougaran | |
| 6,992,952 | B2 | 1/2006 | Endo et al. | |
| 7,030,819 | B2 * | 4/2006 | Horibe | H01Q 1/007 343/702 |
| 8,125,391 | B2 * | 2/2012 | Knudsen | H01Q 1/243 343/700 MS |
| 8,270,914 | B2 | 9/2012 | Pascolini et al. | |
| 8,654,023 | B2 | 2/2014 | Brown et al. | |
| 2002/0163473 | A1 | 11/2002 | Koyama et al. | |
| 2007/0297294 | A1 | 12/2007 | Vuilleumier et al. | |
| 2011/0206097 | A1 | 8/2011 | Darden, IV | |
| 2012/0120772 | A1 | 5/2012 | Fujisawa | |
| 2014/0071004 | A1 | 3/2014 | Jenwatanavet et al. | |
| 2014/0253393 | A1 * | 9/2014 | Nissinen | H01Q 1/36 343/702 |
| 2015/0048981 | A1 * | 2/2015 | Choi | H01Q 5/364 343/718 |

* cited by examiner

*Primary Examiner* — Hoang V Nguyen
(74) *Attorney, Agent, or Firm* — Vierra Magen Marcus LLP

(57) ABSTRACT

A user-wearable device include a wireless transceiver, a primary radiator antenna and a secondary radiator antenna. The primary radiator antenna produces a first radio frequency (RF) radiation pattern when driven by the wireless transceiver, wherein the first RF radiation pattern is at least partially circularly polarized. The secondary radiator antenna, which is spaced apart from the primary radiator antenna, is configured to modify the first RF radiation pattern produced by the primary radiator antenna to thereby produce a second RF radiation pattern having increased RF radiation in a specific direction (e.g., away from the user's/wearer's skin) compared to the first RF radiation pattern. Inclusion of both the primary radiator antenna and the secondary radiator antenna increases an overall antenna efficiency (e.g., by about 3 dB) in the specific direction compared to if only the primary radiator antenna was included.

25 Claims, 4 Drawing Sheets

USER-WEARABLE DEVICES WITH PRIMARY AND SECONDARY RADIATOR ANTENNAS

PRIORITY CLAIM

This application claims priority to U.S. Provisional Patent Application No. 62/058,489, filed Oct. 1, 2014, which is incorporated by reference.

BACKGROUND

User-wearable devices, such as activity monitors or actigraphs, have become popular as a tool for promoting exercise and a healthy lifestyle. Such user-wearable devices can be used, for example, to measure heart rate, steps taken while walking or running and/or estimate an amount of calories burned. Additionally, or alternatively, a user-wearable device can be used to monitor sleep related metrics. User-wearable devices, such as smart watches, can additionally or alternatively be used to provide alerts to a user. Further, such user-wearable devices can be designed to wireless communicate with a base station, such as a smart phone or tablet computer. Such user-wearable devices are typically battery operated. Because such user-wearable devices are often used to perform numerous functions that consume power, if not appropriately designed and operated the battery life of such devices can be relatively short, which is undesirable.

DETAILED DESCRIPTION

Figure 1A:
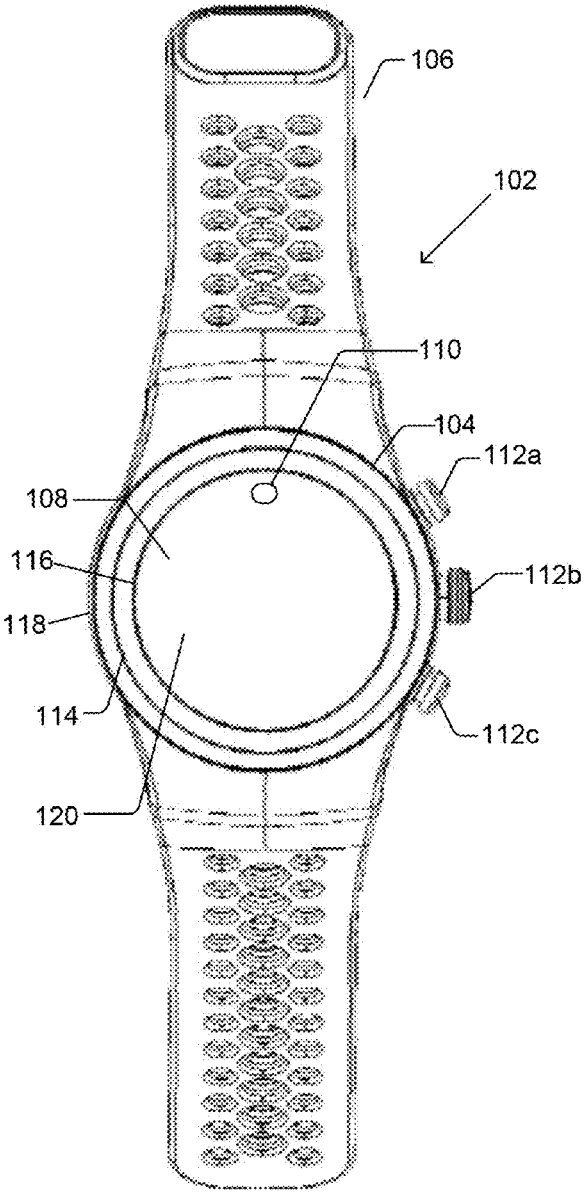
FIG. 1A depicts a front view of a user-wearable device, according to an embodiment.

Certain embodiments of the present technology, where are described below, relate to user-wearable devices that includes a wireless transceiver, a primary radiator antenna and a secondary radiator antenna. The primary radiator antenna produces a first radio frequency (RF) radiation pattern when driven by the wireless transceiver, wherein the first RF radiation pattern is at least partially circularly polarized. The secondary radiator antenna, which is spaced apart from the primary radiator antenna, is configured to modify the first RF radiation pattern produced by the primary radiator antenna to thereby produce a second RF radiation pattern having increased RF radiation in a specific direction (e.g., away from the user's/wearer's skin) compared to the first RF radiation pattern. In an embodiment, inclusion of both the primary radiator antenna and the secondary radiator antenna increases an overall antenna efficiency by about 3 dB in the specific direction compared to if only the primary radiator antenna was included.

In the following detailed description, reference is made to the accompanying drawings that form a part hereof, and in which is shown by way of illustration specific illustrative embodiments. It is to be understood that other embodiments may be utilized and that mechanical and electrical changes may be made. The following detailed description is, therefore, not to be taken in a limiting sense. In the description that follows, like numerals or reference designators will be used to refer to like parts or elements throughout. In addition, the first digit of a reference number identifies the drawing in which the reference number first appears.

FIG. 1A depicts a front view of a user-wearable device 102, according to an embodiment. The user-wearable device 102 can be a standalone device which gathers and processes data and displays results to a user. Alternatively and preferably, the user-wearable device 102 can wirelessly communicate with a base station (252 in FIG. 2), which can be a mobile phone, a tablet computer, a personal data assistant (PDA), a laptop computer, a desktop computer, or some other computing device that is capable of performing wireless communication. The base station can, e.g., include a health and fitness software application and/or other applications, which can be referred to as apps. The user-wearable device 102 can upload data obtained by the device 102 to the base station, so that such data can be used by a health and fitness software application and/or other apps stored on and executed by the base station. Further, where the base station 252 is a mobile phone, the user wearable device 102 can receive alerts or messages from the base station, which can be displayed to the user on the display 108.

The user-wearable device 102 is shown as including a housing 104, which can also be referred to as a case 104. A band 106 is shown as being attached to the housing 104, wherein the band 106 can be used to strap the housing 104 to a user's wrist or arm. The housing 104 is shown as including a digital display 108, which can also be referred to simply as a display. The digital display 108 can be used to show the time, date, day of the week and/or the like. The digital display 108 can also be used to display activity and/or physiological metrics, such as, but not limited to, heart rate (HR), heart rate variability (HRV), calories burned, steps taken and distance walked and/or run. The digital display 108 can also be used to display sleep metrics, examples of which are discussed below. These are just examples of the types of information that may be displayed on the digital display 108, which are not intended to be all encompassing. The band 106, which can also be referred to as a strap because of its function, can be of different lengths than shown. For one example, a longer band 106 can be used to strap the user-wearable device 102 around a user's chest, rather than around a user's wrist. In other words, it is also within the scope of embodiments for the user-wearable device to be a device other than a wrist worn device.

The housing is also shown as including a bezel 114 that holds a crystal 120 in place. The crystal 120, which covers and protects the display 108, can be made mineral glass, sapphire, acrylic, or some other light transmissive material that allows the display 108 to be viewed through the crystal 120. In accordance with an embodiment, which is described in additional detail below, the bezel 114 is made of an electrically conductive metal and operates as a secondary radiator antenna. The bezel 114 includes an inner periphery 116 and an outer periphery 118, with a circumference of the outer periphery 118 being greater than a circumference of the inner periphery 116.

The housing 104 is also shown as including an outward facing ambient light sensor (ALS) 110, which can be used to detect ambient light, and thus, can be useful for detecting whether it is daytime or nighttime, as well as for other purposes. The housing 104 is further shown as including buttons 112*a*, 112*b*, 112*c* which can individually be referred to as a button 112, and can collectively be referred to as the buttons 112. For example, one of the buttons 112 can be a mode select button, while another one of the buttons 112 can be used to start and stop certain features. While the user-wearable device 102 is shown as including three buttons 112, more or less than three buttons can be included. The buttons 112 can additionally or alternatively be used for other functions. For example, one of the buttons 112 (e.g., 112*b*) can function as an ECG electrode.

Figure 2:
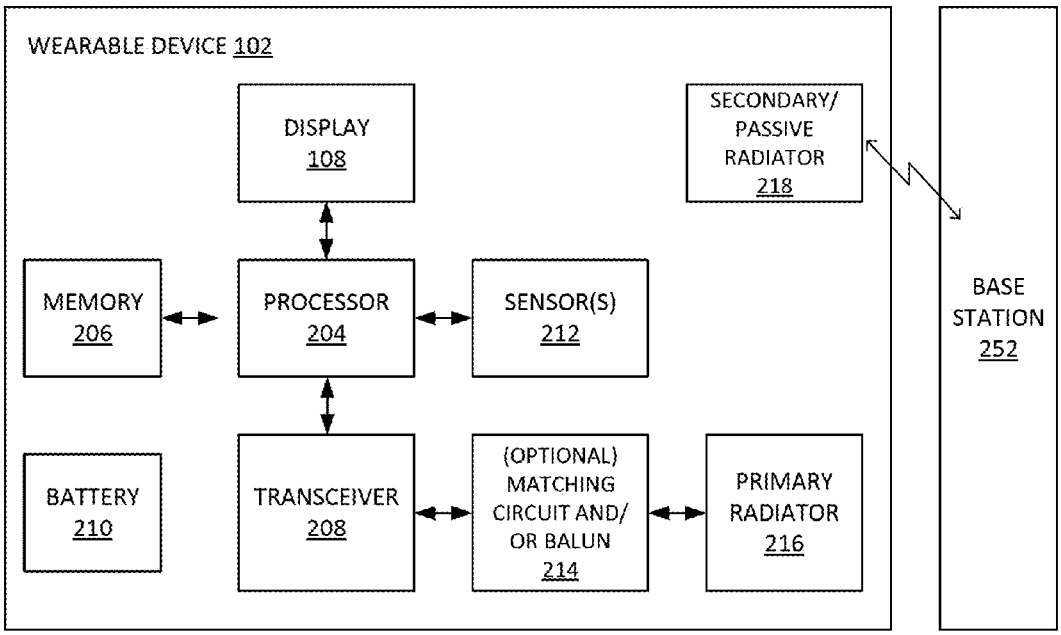
FIG. 2 depicts a high level block diagram of electrical components of the user-wearable device introduced in FIGS. 1A and 1B, according to an embodiment.

As mentioned above, in certain embodiments, the user-wearable device 102 can receive alerts from a base station (e.g., 252 in FIG. 2). For example, where the base station 252 is a mobile phone, the user wearable device 100 can receive alerts from the base station, which can be displayed to the user on the display 108. For a more specific example, if a mobile phone type of base station 252 is receiving an incoming phone call, then an incoming phone call alert can be displayed on the digital display 108 of the mobile device, which may or may not include the phone number and/or identity of the caller. Other types of alerts include, e.g., text message alerts, social media alerts, calendar alerts, medication reminders and exercise reminders, but are not limited thereto. The user-wearable device 102 can inform the user of a new alert by vibrating and/or emitting an audible sound.

Figure 1B:
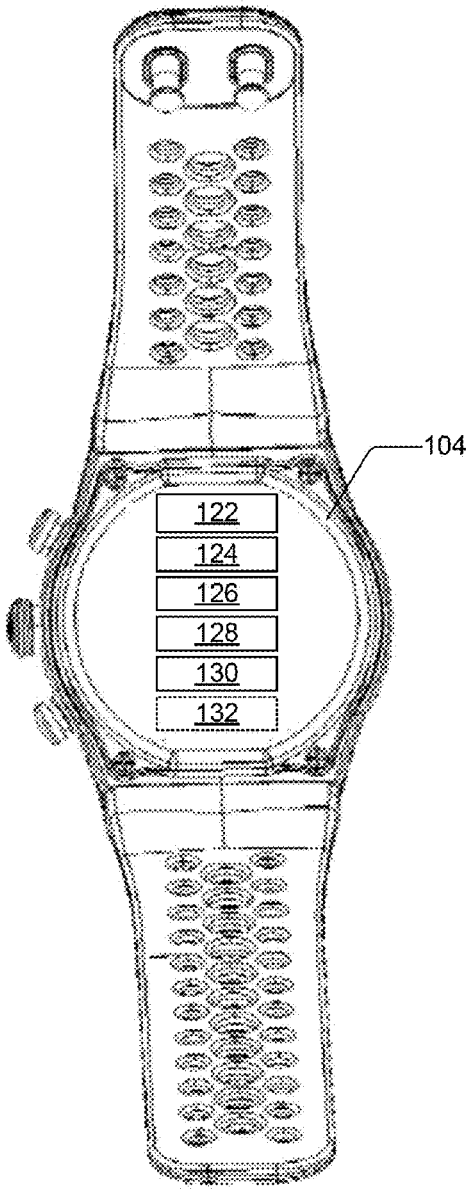
FIG. 1B depicts a rear view of the user-wearable device of FIG. 1A, according to an embodiment.

FIG. 1B illustrates a rear-view of the housing 104 of the user-wearable device 102. Referring to FIG. 1B, the backside of the housing 104 includes an optical sensor 122, a capacitive sensor 124, a galvanic skin resistance sensor 126, an electrocardiogram (ECG) sensor 128 and a skin temperature sensor 130. It is also possible that the user-wearable device 102 includes less sensors than shown, more sensors than shown and/or alternative types of sensors. For example, the user-wearable device 102 can also include one or more type of motion sensor 132, which is shown in dotted line because it is likely completely encased with the housing 104.

In accordance with an embodiment, the optical sensor 122 includes both a light source and a light detector, in which case the optical sensor 122 can be used to detect proximity of an object (e.g., a user's wrist or arm) relative to the optical sensor, as well as to detect ambient light. The light source of the optical sensor 122 can include one or more light emitting diode (LED), incandescent lamp or laser diode, but is not limited thereto. While infrared (IR) light sources are often employed in optical sensors, because the human eye cannot detect IR light, the light source can alternatively produce light of other wavelengths. The light detector of the optical sensor 122 can include one or more one or more photoresistor, photodiode, phototransistor, photodarlington or avalanche photodiode, but is not limited thereto. When operating as an optical proximity sensor, the light source of the optical sensor 122 is driven to emit light. If an object (e.g., a user's wrist or arm) is within the sense region of the optical sensor 122, a large portion of the light emitted by the light source will be reflected off the object and will be incident on the light detector. The light detector generates a signal (e.g., a current) that is indicative of the intensity and/or phase of the light incident on the light detector, and thus, can be used to detect the presence of the user's wrist or arm. The optical sensor 122 may also use its light detector to operate as an ambient light detector. It is also possible that the optical sensor 122 not include a light source, in which case the optical sensor 122 can operate as an ambient light sensor, but not a proximity sensor. When operating as an ambient light sensor, the optical sensor 122 produces a signal having a magnitude that is dependent on the amount of ambient light that is incident on the optical sensor 122. It is expected that when a user is wearing the user-wearable device 102 on their wrist or arm, the light detector of the optical sensor 122 will be blocked (by the user's wrist or arm) from detecting ambient light, and thus, the signal produced the light detector will have a very low magnitude.

In accordance with specific embodiments, the optical sensor 122 can also be used to detect heart rate (HR) and heart rate variability (HRV). More specifically, the optical sensor 122 can operate as a photoplethysmography (PPG) sensor. When operating as a PPG sensor, the light source of the optical sensor 122 emits light that is reflected or backscattered by patient tissue, and reflected/backscattered light is received by the light detector of the optical sensor 122. In this manner, changes in reflected light intensity are detected by the light detector, which outputs a PPG signal indicative of the changes in detected light, which are indicative of changes in blood volume. The PPG signal output by the light detector can be filtered and amplified, and can be converted to a digital signal using an analog-to-digital converter (ADC), if the PPG signal is to be analyzed in the digital domain. Each cardiac cycle in the PPG signal generally appears as a peak, thereby enabling the PPG signal to be used to detect peak-to-peak intervals, which can be used to calculate heart rate (HR) and heart rate variability (HRV). In accordance with certain embodiments, the optical sensor 122 includes a light source that emits light of two different wavelengths that enables the optical sensor 122 to be used as a pulse oximeter, in which case the optical sensor 122 can non-invasively monitor the arterial oxygen saturation of a user wearing the user-wearable device 102.

In accordance with an embodiment, the capacitive sensor 124 includes an electrode that functions as one plate of a capacitor, while an object (e.g., a user's wrist or arm) that is in close proximity to the capacitive sensor 124 functions as the other plate of the capacitor. The capacitive sensor 124 can indirectly measure capacitance, and thus proximity, e.g., by adjusting the frequency of an oscillator in dependence on the proximity of an object relative to the capacitive sensor 124, or by varying the level of coupling or attenuation of an AC signal in dependence on the proximity of an object relative to the capacitive sensor 124.

The galvanic skin resistance (GSR) sensor 126 senses a galvanic skin resistance. The galvanic skin resistance measurement will be relatively low when a user is wearing the user-wearable device 102 on their wrist or arm and the GSR sensor 126 is in contact with the user's skin. By contrast, the galvanic skin resistance measurement will be very high when a user is not wearing the user-wearable device 102 and the GSR sensor 126 is not in contact with the user's skin.

The ECG sensor 128 can be used to obtain an ECG signal from a user that is wearing the user-wearable device 102 on their wrist or arm (in which case the ECG sensor 128, which is an electrode, is in contact with the user's wrist or arm), and the user touches another ECG electrode (e.g., the button 112*b*) with a finger of their other arm. Additionally, or alternatively, an ECG sensor can be incorporated into a chest strap that provides ECG signals to the user-wearable device 102. The skin temperature sensor 130 can be implemented, e.g., using a thermistor, and can be used to sense the temperature of a user's skin, which can be used to determine user activity and/or calories burned.

Depending upon implementation, heart rate (HR) and heart rate variability (HRV) can be detected based on signals obtained by the optical sensor 122 and/or the ECG sensor 128. HR and/or HRV can be automatically determined continuously, periodically or at other specified times or based on a manual user action. For example, in a free living application, HR can be determined automatically during periods of interest, such as when a significant amount of activity is detected.

Additional physiologic metrics can also be obtained using the sensors described herein. For example, respiration rate can be determined from a PPG signal obtained using the optical sensor 122 and/or from the ECG signal determined using the ECG sensor 128. For another example, blood pressure can be determined from PPG and ECG signals by determining a metric of pulse wave velocity (PWV) and converting the metric of PWV to a metric of blood pressure. More specifically, a metric of PWV can be determining by determining a time from a specific feature (e.g., an R-wave) of an obtained ECG signal to a specific feature (e.g., a maximum upward slope, a maximum peak or a dicrotic notch) of a simultaneously obtained PPG signal. An equation can then be used to convert the metric of PWV to a metric of blood pressure.

In accordance with an embodiment the motion sensor 132 is an accelerometer. The accelerometer can be a three-axis accelerometer, which is also known as a three-dimensional (3D) accelerometer, but is not limited thereto. The accelerometer may provide an analog output signal representing acceleration in one or more directions. For example, the accelerometer can provide a measure of acceleration with respect to x, y and z axes. The motion sensor 132 can alternatively be a gyrometer, which provides a measure of angular velocity with respect to x, y and z axes. It is also possible that the motion sensor 132 is an inclinometer, which provides a measure of pitch, roll and yaw that correspond to rotation angles around x, y and z axes. It is also possible the user wear-able device 102 includes multiple different types of motion sensors, some examples of which were just described. Depending upon the type(s) of motion sensor(s) used, such a sensor can be used to detect the posture of a portion of a user's body (e.g., a wrist or arm) on which the user-wearable device 102 is being worn.

FIG. 2 depicts an example block diagram of electrical components of the user-wearable device 102, according to an embodiment. Referring to FIG. 2, the user-wearable device 102 is shown as including a processor 204, memory 206 and a wireless transceiver 208. In accordance with one embodiment, the processor 204, the memory 206 and the wireless transceiver 208 are portions of a microcontroller. As will be described below in additional detail with reference to FIG. 3, the processor 204 can include or implement various modules or detectors.

FIG. 2 also illustrates that the user-wearable device 102 can also include an optional matching circuit and/or balun, as represented by block 214. Additionally, the user-wearable device 102 is shown as including a primary radiator antenna 216 and a secondary radiator antenna 218 that is spaced apart from the primary radiator antenna 216. As will be explain in additional detail below, with reference to FIG. 4, the primary radiator antenna 216 produces a first radio frequency (RF) radiation pattern when driven by the wireless transceiver 208. The secondary radiator antenna 218 modifies the first RF radiation pattern produced by the primary radiator antenna 216 to thereby produce a second RF radiation pattern having increased RF radiation in a direction away from the user's skin compared to the first RF radiation pattern. Advantageously, if designed appropriately, inclusion of both the primary radiator antenna 216 and the secondary radiator antenna 216 increases an overall antenna efficiency by about 3 dB in a direction away from the user's skin compared to if only the primary radiator antenna 216 was included. The wireless transceiver 208, the optional matching circuit and/or balun, the primary radiator antenna 216 and the secondary radiator antenna 218 can collectively be considered components of a wireless interface for the user-wearable device. The wireless interface, and more generally the user wearable device 102, can communicate with a base station 252 using various different protocols and technologies, such as, but not limited to, Bluetooth™, Wi-Fi, ZigBee or ultrawideband (UWB) communication. The base station 252 can be, e.g., a mobile phone, a tablet computer, a PDA, a laptop computer, a desktop computer, or some other computing device that is capable of performing wireless communication.

As mentioned above, the user-wearable device 102 can include an optional matching circuit and/or balun, as represented by block 214. The balun can be used to convert a balanced signal, produced by a transmitter portion of the transceiver 208 to an unbalanced signal that is provided to the primary radiator antenna 216. The balun can also be used to convert an unbalanced signal, received from the primary radiator antenna 216, to a balanced signal that is provided to a receiver portion of the transceiver 208. The matching network can be used, e.g., to cause the antenna to appear like a 50 ohm load looking into antenna, but is not limited thereto. Baluns and matching networks are well known in the art, and thus, need not be described in additional detail.

In FIG. 2 the sensor(s) block 212 represents the aforementioned sensors 110, 122, 124, 126, 128 and 130, and thus, is intended to show that the processor 204 can receive signals from each of the aforementioned sensors 110, 122, 124, 126, 128 and 130. The user-wearable device 102 is also shown as including a battery 210 that is used to power the various components of the device 102. While not specifically shown, the user-wearable device 102 can also include one or more voltage regulators that are used to step-up and or step-down the voltage provided by the battery 210 to appropriate levels to power the various components of the device 102.

Each of the aforementioned sensors 110, 122, 124, 126, 128, 130, 132 can include or have associated analog signal processing circuitry to amplify and/or filter raw signals produced by the sensors. It is also noted that analog signals produced using the aforementioned sensors 110, 122, 124, 126, 128, 130 and 122 can be converted to digital signals using one or more digital to analog converters (ADCs), as is known in the art. The analog or digital signals produced using these sensors can be subject time domain processing, or can be converted to the frequency domain (e.g., using a Fast Fourier Transform or Discrete Fourier Transform) and subject to frequency domain processing. Such time domain processing, frequency domain conversion and/or frequency domain processing can be performed by the processor 204, or by some other circuitry.

Figure 3:
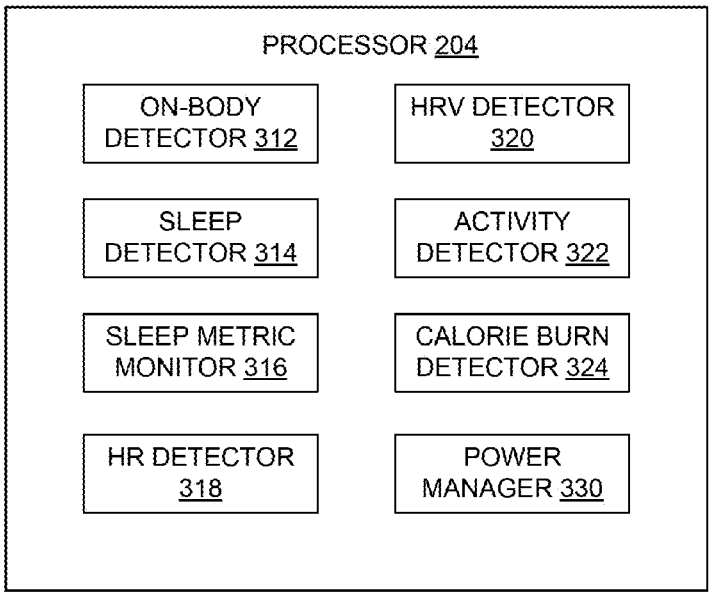
FIG. 3 depicts various modules that can be implemented using one or more of the electrical components introduced in FIG. 2.

In FIG. 3, the user-wearable device 102 is shown as including various modules, including an on-body detector module 312, a sleep detector module 314, a sleep metric module 316, a heart rate (HR) detector module 318, a heart rate variability (HRV) detector module 320, an activity detector module 322, a calorie burn detector module 324 and a power manager module 330. The various modules may communicate with one another, as will be explained below. Each of these modules 312, 314, 316, 318, 320, 322, 324 and 330 can be implemented using software, firmware and/or hardware. It is also possible that some of these modules are implemented using software and/or firmware, with other modules implemented using hardware. Other variations are also possible. In accordance with a specific embodiments, each of these modules 312, 314, 316, 318, 320, 322, 324 and 330 is implemented using software code that is stored in the memory 206 and is executed by the processor 204. The memory 206 is an example of a tangible computer-readable storage apparatus or memory having computer-readable software embodied thereon for programming a processor (e.g., 204) to perform a method. For example, non-volatile memory can be used. Volatile memory such as a working memory of the processor 204 can also be used. The computer-readable storage apparatus may be non-transitory and exclude a propagating signal.

The on-body detector module 312, which can also be referred to simply as the on-body detector 312, uses signals and/or data obtained from one or more of the above described sensors to determine whether the user-wearable device 102 is being worn by a user. Where the user-wearable device has the form factor of a wrist-watch, e.g., as shown in FIGS. 1A and 1B, the on-body detector 312 may be referred to as a wrist-off detector or a wrist-on detector. When the on-body detector 312 detects that the user-wearable device 102 is being worn by a user, wireless communication between the user-wearable device and a base station (e.g., 252) can be enabled. Conversely, when the on-body detector 312 detects that the user-wearable device is not being worn by a user, wireless communication between the user-wearable device and a base station can be disabled in order to conserve power. Additionally, or alternatively, in order to conserver power, one or more of the aforementioned sensors of the user-wearable device 102 can be placed in a low power mode or disabled when the on-body detector 312 detects that the user-wearable device 102 is not being worn by a user. Additional details of the on-body detector 312 are described in commonly assigned U.S. patent application Ser. No. 14/341,248, filed Jul. 25, 2014.

The sleep detector module 314, which can also be referred to simply as the sleep detector 312, uses signals and/or data obtained from one or more of the above described sensors to determine whether a user, who is wearing the user-wearable device 102, is sleeping. For example, signals and/or data obtained using the outward facing ambient light sensor (ALS) 110 and/or the motion sensor 132 can be used to determine when a user is sleeping. This is because people typically sleep in a relatively dark environment with low levels of ambient light, and typically move around less when sleeping compared to when awake. Additionally, if the user's arm posture can be detected from the motion sensor 132, then information about arm posture can also be used to detect whether or not a user is sleeping.

The sleep metric detector module 316, which can also be referred to as the sleep metric detector 316, uses information obtained from one or more of the above described sensors and/or other modules to quantify metrics of sleep, such as total sleep time, sleep efficiency, number of awakenings, and estimates of the length or percentage of time within different sleep states, including, for example, rapid eye movement (REM) and non-REM states. The sleep metric module 316 can, for example, use information obtained from the motion sensor 132 and/or from the HR detector 318 to distinguish between the onset of sleep, non-REM sleep, REM sleep and the user waking from sleep. One or more quality metric of the user's sleep can then be determined based on an amount of time a user spent in the different phases of sleep. Such quality metrics can be displayed on the digital display 108 and/or uploaded to a base station (e.g., 252) for further analysis.

The HR detector module 318, which can also be referred to simply as the HR detector 318, uses signals and/or data obtained from the optical sensor 122 and/or the ECG sensor 128 to detect HR. For example, the optical sensor 122 can be used to obtain a PPG signal from which peak-to-peak intervals can be detected. For another example, the ECG sensor 128 can be used to obtain an ECG signal, from which peak-to-peak intervals, and more specifically R-R intervals, can be detected. The peak-to-peak intervals of a PPG signal or an ECG signal can also be referred to as beat-to-beat intervals, which are intervals between heart beats. Beat-to-beat intervals can be converted to HR using the equation HR=(1/beat-to-beat interval)*60. Thus, if the beat-to-beat interval=1 sec, then HR=60 beats per minute (bpm); or if the beat-to-beat interval=0.6 sec, then HR=100 bpm. The user's HR can be displayed on the digital display 108 and/or uploaded to a base station (e.g., 252) for further analysis.

The HRV detector module 320, which can also be referred to simply as the HRV detector 320, uses signals and/or data obtained from the optical sensor 122 and/or the ECG sensor 128 to detect HRV. For example, in the same manner as was explained above, beat-to-beat intervals can be determined from a PPG signal obtained using the optical sensor 122 and/or from an ECG signal obtained using the ECG sensor 128. HRV can be determined by calculating a measure of variance, such as, but not limited to, the standard deviation (SD), the root mean square of successive differences (RMSSD), or the standard deviation of successive differences (SDSD) of a plurality of consecutive beat-to-beat intervals. Alternatively, or additionally, obtained PPG and/or ECG signals can be converted from the time domain to the frequency domain, and HRV can be determined using well known frequency domain techniques. The user's HRV can be displayed on the digital display 108 and/or uploaded to a base station (e.g., 252) for further analysis.

The activity detector module 322, which can also be referred to simply as the activity detector 322, can determine a type and amount of activity of a user based on information such as, but not limited to, motion data obtained using the motion sensor 132, heart rate as determined by the HR detector 218, an amount of ambient light as determined using the outwardly facing ambient light sensor 110, skin temperature as determined by the skin temperature sensor 130, and time of day. The activity detector module 322 can using motion data, obtained using the motion sensor 132, to determine the number of steps that a user has taken with a specified amount of time (e.g., 24 hours), as well as to determine the distance that a user has walked and/or run within a specified amount of time. Activity metrics can be displayed on the digital display 108 and/or uploaded to a base station (e.g., 252) for further analysis.

The calorie burn detector module 324, which can also be referred to simply as the calorie burn detector 324, can determine a current calorie burn rate and an amount of calories burned over a specified amount of time based on motion data obtained using the motion sensor 132, HR as determined using the HR detector 318, and/or skin temperature as determined using the skin temperature sensor 130. A calorie burn rate and/or an amount of calories burned can be displayed on the digital display 108 and/or uploaded to a base station (e.g., 252) for further analysis.

The power manager module 330, which can also be referred to simply as the power manager 230, uses signals and/or data obtained from one or more of the above described sensors and/or modules to determine when to disable certain circuitry and/or place certain circuitry in a low-power mode. For example, the power manager 330 can disable the transceiver 306 when the user-wearable device 102 is not being worn by a user. For another example, the power manager 330 can disable the optical sensor 122 and the ambient light sensor 110 when the user-wearable device 102 is not being worn by a user. The power manager 230 can also determine when to enable certain circuitry and/or place certain circuitry in a normal-power mode (as opposed to a low-power mode).

Figure 4:
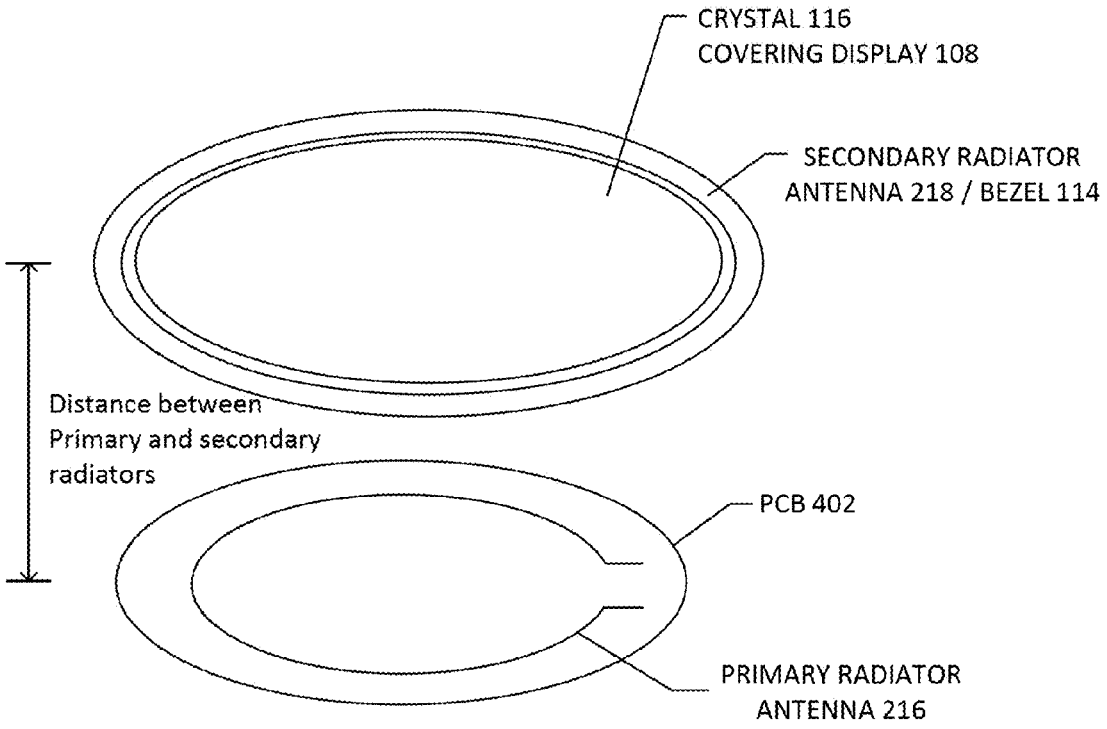
FIG. 4 illustrates additional details of the primary and secondary radiator antennas introduced In FIG. 2.

FIG. 4 will now be used to describe additional details of the primary radiator antenna 216 and the secondary radiator antenna 218 introduced in FIG. 2. Referring to FIG. 4, shown therein is a printed circuit board (PCB) 402 on which one or more of the components described above in the discussion of FIG. 2 can be mounted. For example, the processor 204, memory 206, transceiver 208 and/or the display 108 can be integrated circuits that are mounted to the PCB 402. Where the processor 204, memory 206 and/or transceiver 208 are elements of a microcontroller, the microcontroller, implemented as an integrated circuit chip, can be mounted to the PCB 402. In accordance with an embodiment, the primary radiator antenna 216 is implemented as an electrically conductive trace located on or in the PCB 204. The RF radiation pattern produced by the primary radiator antenna 216 should be circularly polarized, or at least partially circularly polarized. To achieve an at least partially circularized radiation pattern, the primary radiator antenna 216 can be, for example, a loop antenna or a halo antenna type of trace antenna, but is not limited thereto. For other examples, the primary radiator antenna 216 can include two crossed di-poles that provide orthogonal field components, or a microstrip patch antenna that is designed to provide an at partially circularized radiation pattern. These are just a few examples of the types of primary radiator antennas that can be used, which are not intended to be all encompassing.

In accordance with specific embodiments, the secondary radiator antenna 218 is an electrically conductive continuous loop of metal that spaced apart from the PCB 402. For example, as mentioned above, the secondary radiator antenna 218 can be the bezel 114 that holds the crystal 120 in place. Alternatively, the secondary radiator antenna 218 can be an electrically conductive continuous loop that surrounds or covers the bezel 114 that holds the crystal 120 in place. Exemplary metals from which the secondary radiator antenna 218 can be made include, but are not limited to, silver, copper, gold, aluminum, brass, tungsten, zinc and nickel. The secondary radiator antenna 218 can also be referred to as a passive radiator antenna, or a passive radiator, since it is not directly driven by the transceiver 208. In accordance with embodiments, the first and secondary radiator antennas 216 and 218 are not connected to one another by an electrically conductive path.

In accordance with an embodiment, the secondary radiator antenna is integrally formed with the case 104, or is mechanically attached to an exterior of the case 104. Either way, in accordance with an embodiment, the secondary radiator antenna 218 can be viewable by a user. For example, where the secondary radiator antenna 218 is the bezel 114, a user viewing the user wearable device 102 would likely think that the function of the bezel 114 were simply to hold the crystal 120 in place and/or a user may simply think that the bezel 114 is a decorative element. In other words, unless told of its other function, a user would likely not know that the bezel 114 was also functioning as the secondary radiator antenna 218.

The wireless transceiver 208 can be configured to communicate using one or more protocols, examples of which were mentioned above. For example, the wireless transceiver 208 can be configured to communicate using Bluetooth™ or Wi-Fi, both of which can use a frequency band having a range of about 2.4 GHz to 2.5 GHz. To function as a secondary radiator for such a frequency band, the electrically conductive continuous loop of the secondary radiator antenna 218 is preferably a circular ring of an electrically conductive metal having a circumference in a range of about 10 cm to 14 cm. Explained another way, the secondary radiator antenna 218 is preferably a circular ring of an electrically conductive metal have a diameter in a range of 3 cm to 5 cm. In one example, the inner periphery of the secondary radiator antenna 218 has a circumference of 10 cm, the outer periphery of the secondary radiator antenna 218 has a circumference of 14 cm. Explained another way, in one example the inner periphery of the secondary radiator antenna 218 has a diameter of about 3.2 cm and the outer periphery of the secondary radiator antenna 218 has a diameter of about 4.6 cm. In one embodiment where the secondary radiator antenna 218 is the bezel 114 introduced in FIG. 1A, the inner periphery 116 of the bezel 114 can have a circumference of 10 cm, the outer periphery 118 of the bezel can have a circumference of 14 cm, and a mid-point between the inner and outer peripheries 116, 118 of the bezel 114 can have a circumference of 12 cm. Explained another way, in one embodiment the inner periphery 116 of the bezel 114 has a diameter of about 3.2 cm, the outer periphery 118 of the bezel 114 has a diameter of about 4.6 cm, and a mid-point between the inner and outer peripheries 116, 118 of the bezel 114 has a diameter of about 3.9 cm.

It is possible that the secondary radiator antenna 218 has a shape other than a circular shape. For example, it is possible that the secondary radiator antenna 218 can have an oval shape, a rectangular shape, pentagonal shape, a hexagonal shape, a heptagonal shape, an octagonal shape, but is not limited thereto. In certain embodiments, where the secondary radiator antenna 218 has a shape other than a circular shape, the non-circularly shaped secondary radiator antenna 218 may still also function as a bezel, but does not need to, depending upon implementation. Regardless of its shape, if the secondary radiator antenna 218 is intended to act as a secondary radiator for a frequency band having a range of about 2.4 GHz to 2.5 GHz, a total circumferential length of the secondary radiator antenna 218 is preferably in a range of about 10 cm to 14 cm.

In FIG. 4, a plane of the secondary radiator antenna 218 is parallel to a plane of the primary radiator antenna 216. Where the frequency range being used is from about 2.4 GHz to 2.5 GHz, and the total circumferential length of the secondary radiator antenna 218 is in the range of about 10 cm to 14 cm, a distance between the primary radiator antenna 216 and the second radiator antenna 218 (and more specifically, the planes thereof) is preferably in the range of about 5 cm to 6 cm. However, where the thickness of the case 104 is less than 5 cm, as will typically be the case, the desire is to maximize the distance between the primary radiator antenna 216 and the second radiator antenna 218. For example, if the thickness of the case 104 is only 1 cm to 2 cm, it is desirable for the distance between the primary radiator antenna 216 and the second radiator antenna 218 to be as close to the thickness of the case 104 as possible. For a more specific example, where the form factor of the user-wearable device is a wrist watch, e.g., as shown in FIGS. 1A and 1B, the distance between the primary radiator antenna 216 and the second radiator antenna 218 can be maximized by using the bezel 114, which is on the outside of the case 104, as the second radiator antenna 218. Another way to maximize the distance between the primary radiator antenna 216 and the second radiator antenna 218, assuming the primary radiator antenna 216 is implemented as a trace antenna on the PCB 402, is to have the trace antenna type of primary radiator antenna 216 be located on the bottom surface of the PCB 402, with the secondary radiator antenna 218 located above and spaced apart from the top surface of the PCB 402. It would also be possible for the primary radiator antenna 216 to be included within the PCB 402, i.e., between the top and bottom surfaces of the PCB 402. The integrated circuit chip(s) in which the wireless transceiver 208 is implemented can be mounted to the bottom surface of the PCB 402, or alternatively, to the top surface of the PCB 402. Where the display is mounted to the top surface of the PCB 402 and takes up most of the surface area of the top surface of the PCB 402, the other components, such as the wireless transceiver 208, processor 204, memory 206 and/or sensor(s) 212, can be mounted to a bottom surface of the PCB 402.

It is generally desirable to enable a user-wearable device (e.g., 102) to communicate with a base station (e.g., 252) without requiring that the two device be right next to each other. One way to increase the RF communication range of a user-wearable device is to increase the overall system gain. For example, the RF communication range can be doubled by quadrupling the power used to drive an antenna of a user-wearable device (assuming the embodiments described herein were not included in the user-wearable device). For a more specific example, assume that the user-wearable device had a 1 mW transmitter that enabled the device to communicate with a base station located 10 feet away. In order to double the transmission range from 10 feet to 20 feet by solely increasing the power used to drive the antenna, there would be a need to increase the power by factor of 4 (e.g., from 1 mW to 4 mW). Such a technique is undesirable because it would quickly drain the battery (e.g., 210) of the user-wearable device 102. Embodiments of the present technology described herein provide for a more power efficient way of increasing the RF communication range of the user-wearable device 102. More specifically, the inclusion of both the primary radiator antenna 216 and the secondary radiator antenna 218 increases an overall antenna efficiency by about 3 dB in a direction away from the user's (e.g., wearer's) skin compared to if only the primary radiator antenna 218 was included. Such embodiments can be used to increase the RF communication range at a given power level. Alternatively, such embodiments can be used to reduce power consumption for a give RF communication range.

Figure 5:
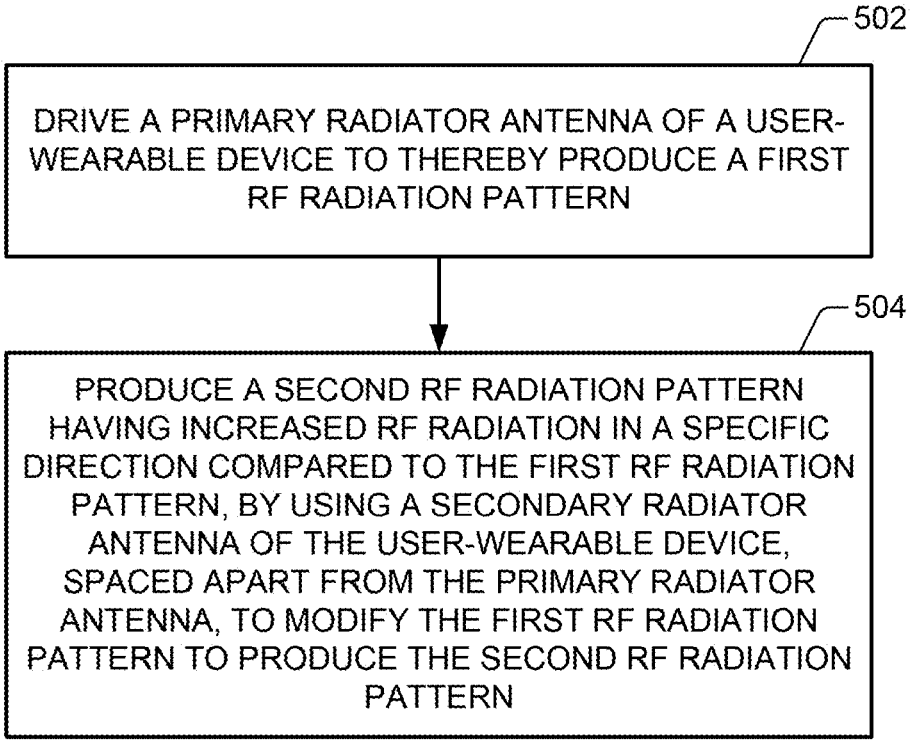
FIG. 5 is a high level flow diagram that is used to summarize methods according to various embodiments.

FIG. 5 is a high level flow diagram that is used to summarize methods according to various embodiments of the present technology. Referring to FIG. 5, step 502 involves driving a primary radiator antenna of the user-wearable device to thereby produce a first radio frequency (RF) radiation pattern. As mentioned above, in specific embodiments the primary radiator antenna can be an electrically conductive trace located on a printed circuit board (PCB) that is within a case of the user-wearable device. Still referring to FIG. 5, step 504 involves producing a second RF radiation pattern having increased RF radiation in a specific direction compared to the first RF radiation pattern, by using a secondary radiator antenna, spaced apart from the primary radiator antenna, to modify the first RF radiation pattern to produce the second RF radiation pattern. As was described above, the first RF radiation pattern, produced at step 502, is preferably at least partially circularly polarized. As was described above, the secondary radiator antenna, used at step 504 to produce the second RF radiation pattern, can be an electrically conductive continuous loop spaced apart from the primary radiator antenna. More specifically, in certain embodiments the electrically conductive continuous loop of the secondary radiator antenna is a ring of an electrically conductive metal that surrounds a display of the user-wearable device, and thus, is viewable to a user.

Certain embodiments of the present technology, which were described in additional detail above, relate to a user-wearable device that includes a wireless transceiver, a primary radiator antenna and a secondary radiator antenna. Optionally, a balun and/or matching circuit can be electrically coupled between the transceiver and the primary radiator antenna. Alternatively, the transceiver and the primary radiator antenna can be electrically coupled to one another without a balun and/or matching circuit. The primary radiator antenna produces a first RF radiation pattern when driven by the wireless transceiver. In preferred embodiments, the first RF radiation pattern is at least partially circularly polarized. The secondary radiator antenna, which is spaced apart from the primary radiator antenna, is configured to modify the first RF radiation pattern produced by the primary radiator antenna to thereby produce a second RF radiation pattern having increased RF radiation in a specific direction (e.g., away from the user's/wearer's skin) compared to the first RF radiation pattern. In an embodiment, inclusion of both the primary radiator antenna and the secondary radiator antenna increases an overall antenna efficiency by about 3 dB in the specific direction compared to if only the primary radiator antenna was included.

In accordance with certain embodiments, with the user-wearable device includes a PCB including a top surface and a bottom surface. In an embodiment, the wireless transceiver is implemented in an integrated circuit chip that is mounted to the PCB, the primary radiator antenna comprises an electrically conductive trace located on or in the PCB, and the secondary radiator antenna comprises an electrically conductive continuous loop spaced apart from the PCB. More specifically, the primary radiator antenna can be located on the bottom surface of the PCB, and the secondary radiator antenna can be located above and spaced apart from the top surface of the PCB to attempt to maximize a distance between the primary and secondary radiator antennas.

In accordance with certain embodiments, the user-wearable device comprises a case that is configured to be strapped to a user's wrist or arm using a band. In such embodiments, the aforementioned PCB, wireless transceiver and primary radiator antenna are located within the case. To attempt to maximize a distance between the primary and secondary radiator antennas, the electrically conductive continuous loop of the secondary radiator antenna can be integrally formed with or mechanically attached to an exterior of the case, and thus, is viewable by a user.

In certain embodiments, the user-wearable device also includes a display that is mounted to the top surface of the PCB, and a crystal that covers the display. In such embodiments, the electrically conductive continuous loop of the secondary radiator antenna can surround the display. More specifically, the electrically conductive continuous loop of the secondary radiator antenna can be a bezel that holds the crystal in place. Alternatively, the electrically conductive continuous loop of the secondary radiator antenna can surround or cover a bezel that holds the crystal in place.

In accordance with certain embodiments, the electrically conductive continuous loop of the secondary radiator antenna comprises a circular ring of an electrically conductive metal, wherein the electrically conductive metal is made of silver, copper, gold, aluminum, brass, tungsten, zinc or nickel, or combinations thereof, but is not limited thereto.

In accordance with certain embodiments, the wireless transceiver is configured to transmit and receive RF signals within a frequency band having a range of about 2.4 GHz to 2.5 GHz. In such embodiments, the electrically conductive continuous loop of the secondary radiator antenna can comprise a circular ring of an electrically conductive metal having a circumference in a range of about 10 cm to 14 cm. In alternative embodiments, the electrically conductive continuous loop of the secondary radiator antenna comprises a non-circular shaped ring of an electrically conductive metal having a total circumferential length in a range of about 10 cm to 14 cm.

The foregoing detailed description of the technology herein has been presented for purposes of illustration and description. It is not intended to be exhaustive or to limit the technology to the precise form disclosed. Many modifications and variations are possible in light of the above teaching. The described embodiments were chosen to best explain the principles of the technology and its practical application to thereby enable others skilled in the art to best utilize the technology in various embodiments and with various modifications as are suited to the particular use contemplated. It is intended that the scope of the technology be defined by the claims appended hereto. While various embodiments have been described above, it should be understood that they have been presented by way of example, and not limitation. It will be apparent to persons skilled in the relevant art that various changes in form and detail can be made therein without departing from the spirit and scope of the invention. The breadth and scope of the present invention should not be limited by any of the above-described exemplary embodiments, but should be defined only in accordance with the following claims and their equivalents.

What is claimed is:

1. A user-wearable device, comprising:

a printed circuit board (PCB);

a wireless transceiver;

a primary radiator antenna that produces a first radio frequency (RF) radiation pattern when driven by the wireless transceiver, said primary radiator antenna comprising an electrically conductive trace located on or in the PCB; and a secondary radiator antenna spaced apart from the primary radiator antenna, said secondary radiator antenna comprising an electrically conductive continuous loop spaced apart from the PCB, and said secondary radiator antenna configured to modify the first RF radiation pattern produced by the primary radiator antenna to thereby produce a second RF radiation pattern having increased RF radiation in a specific direction compared to the first RF radiation pattern.

2. The user-wearable device of claim 1, wherein inclusion of both the primary radiator antenna and the secondary radiator antenna increases an overall antenna efficiency by about 3 dB in the specific direction compared to if only the primary radiator antenna was included.

3. The user-wearable device of claim 1, wherein the wireless transceiver is implemented in an integrated circuit chip that is mounted to the PCB.

4. The user-wearable device of claim 1, wherein:

the PCB includes a top surface and a bottom surface;

the primary radiator antenna is located on the bottom surface of the PCB; and the secondary radiator antenna is located above and spaced apart from the top surface of the PCB.

5. The user-wearable device of claim 4, wherein the user-wearable device comprises a case that is configured to be strapped to a user's wrist or arm using a band; and wherein the PCB, the wireless transceiver and the primary radiator antenna are located within the case.

6. The user-wearable device of claim 5, wherein the electrically conductive continuous loop of the secondary radiator antenna is integrally formed with or mechanically attached to an exterior of the case, and thus, is viewable by a user.

7. The user-wearable device of claim 6, further comprising:

a display mounted to a top surface of the PCB; and a crystal that covers the display;

wherein the electrically conductive continuous loop of the secondary radiator antenna surrounds the display.

8. The user-wearable device of claim 7, wherein the electrically conductive continuous loop of the secondary radiator antenna comprises a bezel that holds the crystal in place.

9. The user-wearable device of claim 7, wherein the electrically conductive continuous loop of the secondary radiator antenna surrounds or covers a bezel that holds the crystal in place.

10. The user-wearable device of claim 1, wherein the electrically conductive continuous loop of the secondary radiator antenna comprises a circular ring of an electrically conductive metal.

11. The user-wearable device of claim 10, wherein the electrically conductive metal is selected from the group consisting of silver, copper, gold, aluminum, brass, tungsten, zinc and nickel.

12. The user-wearable device of claim 1, wherein:

the wireless transceiver is configured to transmit and receive RF signals within a frequency band having a range of about 2.4 GHz to 2.5 GHz; and the electrically conductive continuous loop of the secondary radiator antenna comprises a circular ring of an electrically conductive metal having a circumference in a range of about 10 cm to 14 cm.

13. The user-wearable device of claim 1, wherein:

the wireless transceiver is configured to transmit and receive RF signals within a frequency band having a range of about 2.4 GHz to 2.5 GHz; and the electrically conductive continuous loop of the secondary radiator antenna comprises a non-circular ring of an electrically conductive metal having a total circumferential length in a range of about 10 cm to 14 cm.

14. The user-wearable device of claim 1, wherein the wireless transceiver, the primary radiator antenna and the secondary radiator antenna are components of a wireless communication interface that enables the user-wearable device to wirelessly communicate with a further device.

15. The user-wearable device of claim 14, wherein the wireless communication interface further comprises at least one of a matching network and a balun.

16. A method for use by a user-wearable device, the method comprising:

(a) driving a primary radiator antenna to thereby produce a first radio frequency (RF) radiation pattern, the primary radiator antenna comprising an electrically conductive trace located on or in a printed circuit board (PCB) that is within a case of the user-wearable device; and (b) producing a second RF radiation pattern having increased RF radiation in a specific direction compared to the first RF radiation pattern, by using a secondary radiator antenna, spaced apart from the primary radiator antenna, to modify the first RF radiation pattern to produce the second RF radiation pattern, the secondary radiator antenna comprising an electrically conductive continuous loop spaced apart from the primary radiator antenna.

17. The method of claim 16, wherein the first RF radiation pattern, produced at step (a), is at least partially circularly polarized.

18. The method of claim 16, wherein the driving at step (a) is performing by a wireless transceiver that is implemented in an integrated circuit chip that is mounted to the PCB.

19. The method of claim 16, wherein the electrically conductive continuous loop of the secondary radiator antenna comprises a ring of an electrically conductive metal that surrounds a display of the user-wearable device, and thus, is viewable to a user.

20. The user-wearable device, comprising:

a case;

a band attached to the case and configured to strap the case to a portion of a user's body;

a printed circuit board (PCB) within the case and including a top surface and a bottom surface;

a display within the case and mounted to the top surface of the PCB;

a crystal that covers the display;

a bezel that attaches the crystal to the case;

a wireless transceiver; and a primary radiator antenna that produces a radio frequency (RF) radiation pattern when driven by the wireless transceiver, the primary radiator antenna comprising an electrically conductive trace located on or in the PCB;

wherein the bezel comprises an electrically conductive continuous loop spaced apart from the PCB and that acts as a secondary radiator antenna that modifies the RF pattern produced by the primary radiator antenna.

21. The user-wearable device of claim 20, wherein the bezel is made of an electrically conductive metal that is selected from the group consisting of silver, copper, gold, aluminum, brass, tungsten, zinc and nickel.

22. The user-wearable device of claim 20, wherein:

the wireless transceiver is configured to transmit and receive RF signals within a frequency band having a range of about 2.4 GHz to 2.5 GHz; and the bezel has a circumference in a range of about 10 cm to 14 cm.

23. The user-wearable device of claim 20, further comprising at least one of a matching network and a balun electrically coupled between the wireless transceiver and the primary radiator antenna.

24. The user-wearable device of claim 20, wherein the wireless transceiver is implemented in an integrated circuit chip that is mounted to the bottom surface of the PCB.

25. The user-wearable device of claim 24, wherein the electrically conductive trace that comprises the primary radiator antenna is located on the bottom surface of the PCB.

* * * * *